United States Patent [19]

Sobottka

[11] Patent Number: 4,652,846

[45] Date of Patent: Mar. 24, 1987

[54] SMALL TRANSFORMER WITH SHIELD

[75] Inventor: Ulrich Sobottka, Delmenhorst, Fed. Rep. of Germany

[73] Assignee: Siemens Aktiengesellschaft, Berlin and Munich, Fed. Rep. of Germany

[21] Appl. No.: 830,802

[22] Filed: Feb. 19, 1986

Related U.S. Application Data

[63] Continuation of Ser. No. 627,180, Jul. 2, 1984, abandoned.

[30] Foreign Application Priority Data

Aug. 4, 1983 [DE] Fed. Rep. of Germany ... 8322540[U]

[51] Int. Cl.[4] ..... H01F 15/04; H01F 27/30

[52] U.S. Cl. ..... 336/84 C; 336/208

[58] Field of Search ..... 336/198, 208, 84 R, 336/84 C; 242/118.41; 310/194

[56] References Cited

U.S. PATENT DOCUMENTS

| | | | |
|---|---|---|---|
| 1,893,618 | 1/1933 | Forbes | 336/84 |
| 2,714,710 | 8/1955 | Bradley | 336/84 |
| 3,227,973 | 1/1966 | Gray | 333/78 |
| 3,277,416 | 10/1966 | Barr | 336/84 |
| 3,689,862 | 9/1972 | Hilgers | 336/208 |
| 3,843,946 | 10/1974 | Anderson et al. | 336/90 |
| 3,851,287 | 11/1974 | Miller et al. | 336/84 |
| 4,000,483 | 12/1976 | Cook et al. | 336/98 |
| 4,250,479 | 2/1981 | Bausch et al. | 336/208 |

FOREIGN PATENT DOCUMENTS

| | | |
|---|---|---|
| 7105903 | 2/1971 | Fed. Rep. of Germany . |
| 1240795 | 7/1971 | United Kingdom . |

*Primary Examiner*—Thomas J. Kozma

*Attorney, Agent, or Firm*—Volker R. Ulbrich

[57] ABSTRACT

A transformer of small installed volume which affords, besides electrical separation, also an effective static protective shield between the power supply side and the user side, along with simple production and assembly. To accomplish this, a two-chamber transformer with a coil form for the primary winding and a coil form for the secondary winding, both plugged one behind the other onto the transformer core in the direction of the coil axes and a stamped metal foil frame as the shielding wall between the adjacent face flanges of the coil forms are used. The transformer is particularly well suited for application in equipment of the entertainment, communications and medical technologies.

2 Claims, 3 Drawing Figures

SMALL TRANSFORMER WITH SHIELD

This is a continuation of application Ser. No. 627,180, filed July 2, 1984, now abandoned.

BACKGROUND OF THE INVENTION

The invention relates to a small transformer having a primary winding coil form and a secondary coil winding form which can be plugged one behind the other on a transfomer core.

In a typical transformer, to assure longer leakage and air paths between primary and secondary windings due to stricter test voltage requirements while at the same time retaining the transformer's small size, the primary winding is separated from the secondary winding, located next to it in the axial direction of the transformer core, by an electrically insulating partitioning wall whose outside edge is bent in the axial direction and appropriately extended axially to obtain the required air and leakage paths. The partitioning wall is either a deep-drawn insulating foil inserted between the coil form flanges of the primary and secondary windings, with an encircling extension prolonged in the axial direction of the coils, or else the face flange of the primary winding itself is used as a partitioning wall and is provided with an axially oriented extension molded on to conform to the encircling extension of the deep-drawn insulating foil.

SUMMARY OF THE INVENTION

It is an object of the present invention to assure not only a safe electrical separation of the powerline operated primary winding from the secondary winding on the user side, but also a safe static protective shield between the primary and secondary sides of the small transformer while at the same time keeping production and assembly costs low and the installed size small.

Such protective shielding is required, for example, in transformers for electronic entertainment equipment or for medical applications. Usually, a transformer with concentrically arranged primary and secondary windings is used therefor, and for mutual shielding a metal screen is installed between the concentric windings, which covers at least the full width of one of the two adjacent windings. The required spacings as well as the air and leakage paths between metal screen and windings must be assured through additional insulation barriers.

Starting with a transformer of the type already described, which is uncommon per se for such purposes, the object is achieved by the present invention.

In general, the invention features a small transformer with a primary winding coil form and a secondary winding coil form which can be plugged one behind the other onto a transformer core, each coil form including at least one hollow part, its inside enclosing the transformer core and its outside accomodating the winding, the hollow parts having radially extending face flanges at their ends, and with a partitioning wall disposed perpendicular to the coil axis between the mutually adjacent face flanges of the primary winding coil form and the secondary winding coil form, wherein a merely stamped out metal foil frame with a center opening fitting the hollow part is disposed as the partitioning wall between the two face flanges of the coil forms.

In preferred embodiments of the invention the metal foil frame is interrupted by a slot; the outer rim of the adjacent face flange of the one coil form is provided with a collar overlapping the adjacent face flange of the other coil form axially, and the metal foil frame is inserted into the face flange formed by the face flange and the collar; the metal foil frame is oversized, at least over a part of its outer edge, so that this rim portion protrudes out of the assembled coil forms with an externally accessible connector part for a ground conductor; the inner edges of the two adjacent face flanges of the coil forms are provided with encircling, molded-on projections which are directed towards each other, overlapping each other in the assembled state of the coil forms and engaging the center opening of the metal coil frame; and the coil forms with their radially outer and radially inner projections are designed as single-piece, injection molded plastic parts.

The design according to the invention results in low production and assembly costs for a transformer whose coil forms on the primary and secondary sides can be wound independent of each other and with which, compared to transformers with shielded, concentric coils, a considerably better attenuation of high-frequency interference voltages being obtainable by simply interposing the metal foil frame when assembling the separate coil forms on the transformer core. In the frequency range from 10 KHz to 25 MHz, the interference voltage is damped by 20 dB more than in a comparable, shielded, concentric winding.

To avoid eddy current losses due to a shorted turn which is possible because of the stamped metal foil frame, provision is made for the metal foil frame to be interrupted by a slot. In another embodiment of the invention the one adjacent face flange of the one coil form is provided, at its outer edge, with a collar overlapping the adjacent face flange of the other coil form axially. The metal foil frame can then be inserted into the face flange and it can be formed by the face flange and collar; this assures, on the one hand, a simple plug-in assembly of the two coil forms to be mounted one behind the other with simultaneously increased air and leakage path lengths due to the collar design and, on the other hand, a secure fixation of the metal foil frame, attainable in one operation. If the metal foil frame is appropriately oversized, at least over a part of its outer edge, the rim portion of the flat stamped metal foil frame can at the same time be bent in such a manner when plugging the two coil forms into each other as described above that a terminal part projects out of the assembled coil forms and is accessible as a soldering tab for an external ground conductor.

An undesired contact of the metal foil frame and the transformer core can be avoided in a simple manner in the embodiment of a separating transformer according to the invention by molding onto the inner edges of the two adjacent coil form face flanges encircling projections which axially oppose each other and which interlock in the assembled state of the coil forms and engage the center opening of the metal foil frame; at the same time, these projections can help to align the two serially plugged-in coil forms of the transformer.

Other features and advantages of the present invention will become apparent from the following detailed description, and from the claims.

For a full understanding of the present invention, reference should now be made to the following detailed description and to the accompanying drawings.

DETAILED DESCRIPTION

Figure 1:
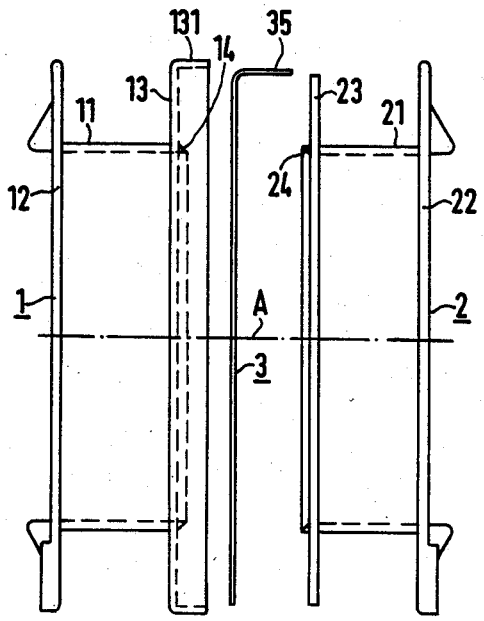
FIG. 1 is a side view of the unwound coil forms shown in exploded view in the axial direction, with the metal foil frame interposed.
Figure 2:
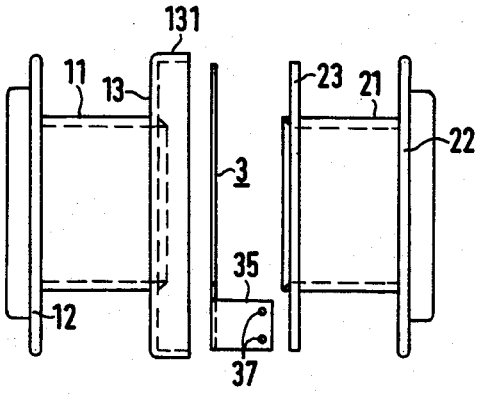
FIG. 2 is a top view of the arrangement shown in FIG. 1.

FIGS. 1 and 2 show coil forms 1, 2 arranged one behind the other in coil axis direction A, but not yet plugged into each other in their final assembly position, for a primary winding on the powerline side to be wound onto coil form 1 and a secondary winding on the user side to be wound onto coil form 2, with metal foil frame 3 disposed between two coil forms 1, 2. Each coil form consists of at least one hollow part 11, 21, respectively, their insides enclosing the transformer core (not shown here), and the primary and secondary windings, respectively, (not shown here), to be wound on their outsides, and of face flanges 12, 13 and 22, 23, respectively, which project beyond hollow part 11, 21 respectively radially to define the primary and secondary winding spaces on the faces. At the same time there may be molded to outer face flanges 12, 22 terminal boards (not shown here) to receive terminals connected on the one hand to inner winding ends of the primary and secondary windings, respectively, and on the other hand to connecting lines on the power and user sides, respectively.

The outer rim of the right face flanges of coil form 1 is provided with collar 131 directed axially towards adjacent face flange 23 of coil form 2 so that a face flange can is formed from the actual face flange 13 and molded-on collar 131. The adjacent face flanges 23 of coil form 2 is shaped and designed so in its radial direction it can be plugged form-lockingly into the face flange receptacle (formed from flange 13 and collar 131) of coil form 1. When assembling two coil forms 1, 2, the metal foil frame previously inserted in this manner can be fixed at the same time in this assembly operation.

Advantageously, metal foil frame 3 is sufficiently oversized so that an appropriate rim portion is bent in the form of an externally accessible connector part 35 when coil forms 1, 2 are plugged together, protruding out of assembled coil forms 1, 2 with a soldering tab connector 37 provided for a ground connection.

Figure 3:
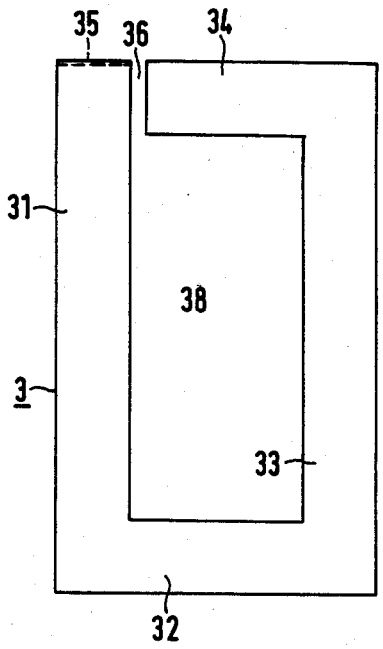
FIG. 3 is a top view of the face of a single metal foil frame.

Metal foil frame 3 shown in FIG. 3 in a top view consists of four legs 31, 32, 33, 34 which enclose center opening 38 fitting hollow part 11 or 21 of coil forms 1, 2. The metal foil frame is interrupted between leg 34 and leg 31 by a slot 36 so that metal foil frame 3 cannot form a shorted winding closed in itself, which could lead to the formation of undesired eddy currents. If the metal foil frame is to be connected to an external ground conductor to obtain protective shielding and contact between metal foil frame 3 and the transformer core penetrating center opening 38 is to be avoided by all means. In such a case it may be advantageous to provide the inner edges of the two adjacent face flanges 13, 23 of coil forms 1, 2, respectively, with molded-on, encircling projections directed axially towards each other in the form of protrusions 14, 24 which engage each other in the assembled state of coil forms 1, 2, thereby fitting center opening 38 of metal foil frame 3 so that an insulation provided by the projections of the preferably injection molded plastic coil forms is assured between the inner leg edges of metal foil frame 3 and the transformer core.

There has thus been shown and described a small transformer which fulfills all the objects and advantages sought therefor. Many changes, modifications, variations and other uses and applications of the subject invention will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. A small transformer having aligned along an axis of symmetry (A), a first winding coil form with a first hollow part and a first winding on said hollow part, a second winding coil form with a second hollow part and a second winding on said second hollow part, and a transformer core passing through said first hollow part and said second hollow part; each said hollow part providing physical support for each respective winding and electrical insulation for each respective winding from said transformer core, and having an outer, radially projecting flange located on an end further from the other coil form; an inner, radially projecting flange located on an end opposite to said outer flange; and an axially inward protrusion molded on and projecting from each inner, radially projecting flange comprising:

a collar molded on a perimeter of one of said inner, radially projecting flanges and extending axially towards the other coil form forming a receptacle flange encircling the axially inward protrusion;

the other inner, radially projecting flange forming a plug flange for engaging said receptacle flange;

said axially inward protrusions engage each other during engagement of said plug flange with said receptacle flange;

said engaged flanges providing physical support and electrical insulation between said first and second winding;

a metal foil partitioning wall, having a stamped-out center opening for surrounding said axial protrusions during engagement thereof, providing a static, protective shield between said first and second winding, located between said receptacle flange and said plug flange, said metal foil partitioning wall providing said static, protective shield by bending at least in part to a shape of said receptacle flange and the axial protrusion thereon, under the influence of said plug flange and the axial protrusion thereon, during engagement;

said engaged plug and receptacle flange and engaged axial protrusions providing physical support and electrical insulation of said metal foil partitioning wall from said transformer core, said first winding and said second winding; and a connector part of said metal foil partitioning wall protruding from said engaged plug and receptacle flanges for connecting a ground conductor providing ground potential protection shielding in addition to static shielding between said first and second winding.

2. The small transformer according to claim 1, wherein each coil form is a single piece, injection molded plastic part having the respective outer, radially projecting flange, inner radially projecting flange, and axially inward protrusion integrally connected thereto.

* * * * *